US005163250A

United States Patent [19]

Weber

[11] Patent Number: 5,163,250

[45] Date of Patent: Nov. 17, 1992

[54] SECURING APPARATUS FOR TOOLS

[76] Inventor: Rudolf Weber, Am Sportplatz 3, 8702 Neubrunn-Böttigheim, Fed. Rep. of Germany

[21] Appl. No.: 428,367

[22] Filed: Oct. 27, 1989 (Under 37 CFR 1.47)

[30] Foreign Application Priority Data

Oct. 28, 1988 [DE] Fed. Rep. of Germany ... 8813580[U]

[51] Int. Cl.[5] ..... B24B 41/04

[52] U.S. Cl. ..... 51/168; 51/170 PT; 51/170 T

[58] Field of Search ..... 51/168, 170 PT, 170 T, 51/372, 373; 125/13.01; 83/481, 491, 543, 591, 665, 666; 30/388

[56] References Cited

U.S. PATENT DOCUMENTS

| | | | |
|---|---|---|---|
| 519,892 | 5/1894 | Newton | 83/666 |
| 2,616,230 | 11/1952 | Hough | 51/168 |
| 3,130,978 | 4/1964 | Van Roojen | 51/168 |
| 4,677,792 | 7/1987 | Speidel | 51/168 |

*Primary Examiner*—Bruce M. Kisliuk
*Assistant Examiner*—Bryan S. Reichenbach
*Attorney, Agent, or Firm*—Robert W. Becker

[57] ABSTRACT

A securing apparatus for a tool, especially a grinding wheel, including a rotatably driven spindle and a hydraulically expandable securing member, which is provided for securing the tool on the spindle and is provided with at least one hydraulic medium chamber. The securing member is a securing sleeve that is provided on the spindle, with the at least one hydraulic medium chamber communicating with a first bore that extends through the spindle and is provided for supplying the hydraulic medium. The spindle is provided with a tightening screw that can selectively close off the first bore and can be backed off into a pressure relief position. At least one axial securing element is disposed on the securing apparatus in such a way as to be axially displaceable and is adapted to be positively connected with the tool in the axial direction.

15 Claims, 2 Drawing Sheets

SECURING APPARATUS FOR TOOLS

BACKGROUND OF THE INVENTION

The present invention relates to a clamping or securing apparatus for tools, especially for grinding wheels, and includes a rotatably driven spindle and a hydraulically expandable clamping or securing member, which is provided for securing a tool on the spindle and is provided with at least one hydraulic medium chamber.

With the known securing apparatus of this general type, the tool itself is provided with the securing member. After the tool and its securing member have been pressed onto the spindle, the hydraulic medium must be placed under pressure so that the securing member will expand resiliently. As a result, the tool is radially secured upon the spindle, and is hereby also radially centered. In order to assure a precise position of the tool, the latter is pressed onto the securing sleeve until an abutment on the securing apparatus is reached.

It is an object of the present invention to embody a securing apparatus of the aforementioned general type in such a way that a simple replacement or exchange of the tools is possible while nevertheless permitting a reliable securement of the tools.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
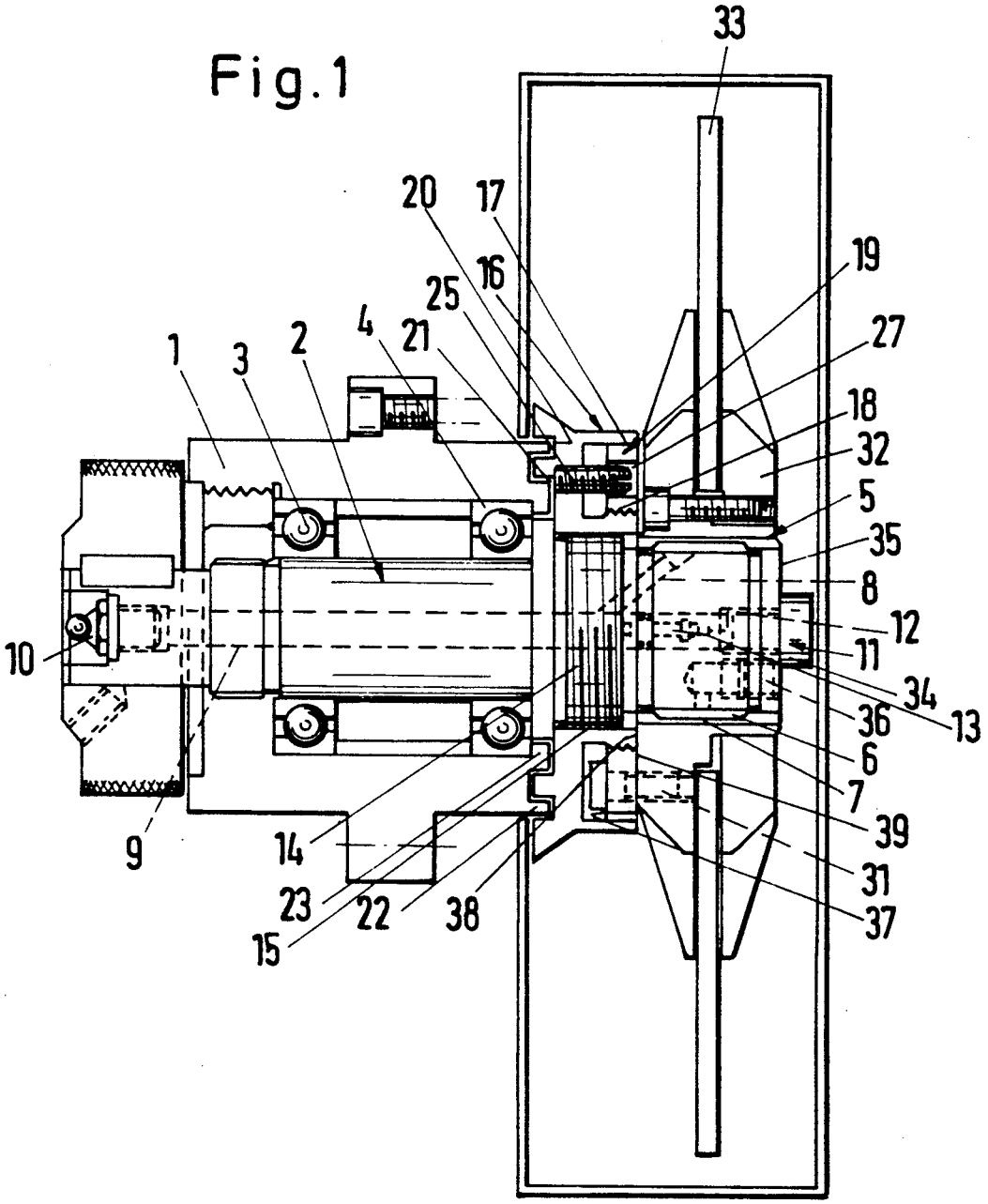
FIG. 1 is an axial cross-sectional view through one exemplary embodiment of the inventive securing apparatus.

The securing apparatus of the present invention is characterized primarily in that: the securing member is a securing hub or sleeve that is provided on the spindle, with the at least one hydraulic medium chamber communicating with a first bore that extends through the spindle and is provided for supplying hydraulic medium; the spindle is provided with a tightening screw that can selectively close off the first bore and can be backed off into a pressure release position; and at least one axial securing element is provided that is disposed on the securing apparatus in such a way as to be axially displaceable and is adapted to be positively connected with the tool in the axial direction.

With the inventive securing apparatus, the resiliently expandable securing member is no longer a part of the tool, but rather is provided on the spindle. The tools can therefore have a simple and straightforward construction. In particular, conventional tools can now also be hydraulically secured. If with the inventive securing apparatus a tool is to be removed, then it is merely necessary to back the tightening screw off into its pressure relief position. The tool can then be removed from the securing sleeve without difficulty. If a tool is to be clamped or secured, it is then merely necessary to screw the securing or tightening screw out of the pressure relief position and back into its securing position. In so doing, the pressure medium in the bore of the spindle is brought to the desired securing pressure. As a result, the tools can be removed and secured very quickly, and above all these processes can be undertaken in a very simple manner. By means of the axial securing element, the tool is additionally axially fixed and secured for its radial centering and securing via the securing sleeve. The axial securing element is positively connected with the tool in the axial direction, so that during axial displacement of the axial securing element, the tool is then shifted in the axial direction and can, for example, be pulled or tightened against an abutment surface. This enables a satisfactory positioning of the tool in the securing apparatus not only in a radial direction but also in an axial direction. The tool is therefore seated on the spindle, i.e. the securing sleeve thereof, in a precisely aligned manner.

Further specific features of the present invention will be described in detail subsequently.

DESCRIPTION OF PREFERRED EMBODIMENTS

Referring now to the drawings in detail, the inventive clamping or securing apparatus serves to secure tools, especially grinding wheels. The securing apparatus is provided on a machine and has a housing 1 in which a spindle 2 is rotatably mounted via antifriction bearings 3, 4. Toward the front, the spindle 2 projects out of the housing 1 and carries on its free end a clamping or securing hub or sleeve 5, which is embodied as a hydraulic sleeve and is provided with one or more chambers 6 that are closed-off axially. Radially inwardly, the chamber 6 is delimited by the spindle 2, and radially outwardly the chamber 6 is delimited by a resiliently deformable wall portion 7 of the securing sleeve 5. At least one transverse bore 8 that extends through the spindle 2 opens out into the chamber 6; the transverse bore or bores 8 establish communication between the chamber 6 and a bore 9 that extends centrally and axially through the spindle 2. The securing sleeve 5 is mounted on the free end of the spindle 2. The bore 9 is closed off by a filling valve 10 via which a pressure medium is introduced into the bore 9.

At the opposite end, the bore 9 is closed off by a tightening screw 11 that is screwed into a threaded bore 12 of the spindle 2, with the end of the threaded bore 12 being open. Disposed in the bore 9 is a clamping or securing piston 13, with the end face of the piston 13, under the pressure of the pressure medium in the bore 9, resting against the tightening screw 11 (FIG. 1). The securing piston 13 is guided in the bore 9 in a sealed manner, so that the pressure medium cannot escape to the outside between the securing piston and the wall of the bore 9.

In the region between the securing sleeve 5 and the antifriction bearing 4, the spindle 2, in the region beyond the housing 1, is provided with a collar 14 that has an enlarged outer diameter and that has the external thread 15. Screwed onto the collar 14 is a centrifugal ring 16 that is provided on that side thereof that faces the securing sleeve 5 with a recess 17 that is on the end and is disposed coaxial to the spindle 2. The recess 17 is provided with an internal thread 18, and a ring 19 can be screwed into this recess 17.

On that side opposite the recess 17, the centrifugal ring 16 is provided with two coaxial, annular recessed portions 20 and 21 into which the housing 1 extends, with play, via appropriate annular ribs 22 and 23 that are similarly disposed coaxial to the spindle 2. Provided in the centrifugal ring 16, diametrically across from one another, are two stop means 24 and 25 that are preferably embodied as setscrews. The stop means 24, 25 extend into the annular recess 17 of the centrifugal ring 16 (FIG. 1). If the stop means 24, 25 are embodied as screws, they can be easily disposed in the centrifugal ring 16 in such a way that they do not extend out of the recess 17.

Figure 2:
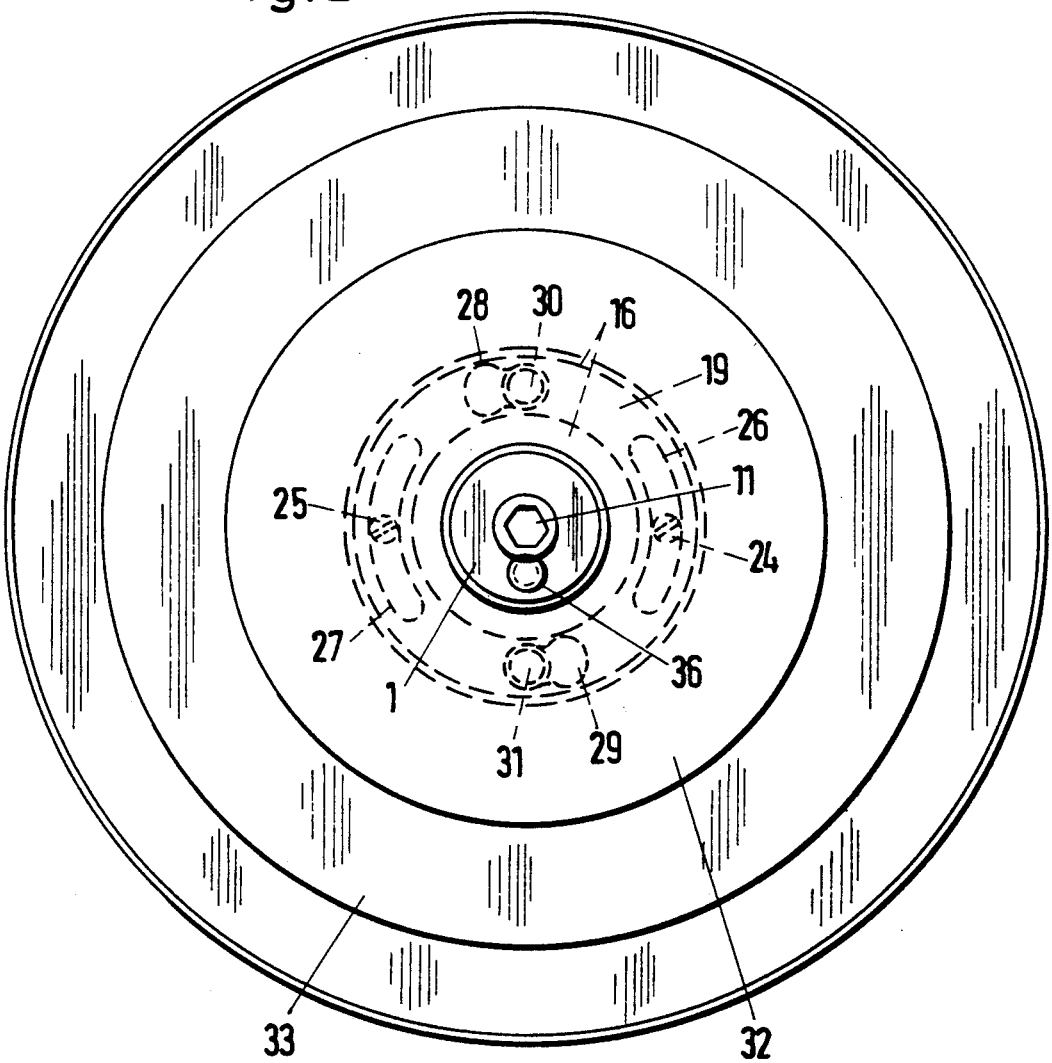
FIG. 2 is an end view of the securing apparatus of FIG. 1.

Each of the stop means 24 and 25 of the centrifugal ring 16 extends into an elongated opening 26 and 27 that is provided in the ring 19 and is curved in the shape of part of a circle (FIG. 2). Each of the openings 26, 27 has the same length, and these openings are disposed diametrically across from one another.

In addition, the ring 19 is provided with two keyhole-like openings 28 and 29 that are disposed diametrically across from one another (FIG. 2). These openings 28, 29 serve to receive screws 30, 31 that are provided on a holder 32 for the tool 33 that is to be secured.

As can be seen from FIG. 2, the openings 28, 29 of the ring 19 are disposed halfway between the openings 26 and 27. In this connection, the larger portion of the opening 28 faces the opening 27, and the larger portion of the opening 29 faces the opening 26.

To place the securing apparatus into operation, pressure medium is introduced into the bore 9 via the filling valve 10. In this connection, the pressure medium is preferably grease that is introduced via a grease gun. By means of this pressure medium, a securing pressure of, for example, approximately 300 to 500 bar is nonrecurrently produced. During filling of the bore 9, the tightening screw 11 is screwed in to such an extent that the head 34 thereof rests against the planar end face 35 of the spindle 2. Under the effect of the pressure, the securing piston 13 is pressed firmly against the tightening screw 11. Via the transverse bore or bores 8, the pressure medium arrives into the chamber or chambers 6, as a result of which the wall portion 7 of the securing sleeve 5 is resiliently deformed in a radially outward direction. In this way, the holder 32 that is seated on the securing sleeve 5 and is provided with the tool 33 is centered and radially secured on the securing sleeve. If the tool and holder are to be removed, it is merely necessary to loosen the tightening screw 11, which results in a shifting of the securing piston 13 in the bore under the securing pressure. As a result, the pressure medium is relieved and the deformation of the wall portion 7 of the securing sleeve 5 is reduced or eliminated, so that the tool 33 along with the holder 32 can be easily removed. If a tool is again placed upon the securing sleeve 5, the tightening screw 11 is then merely screwed back into the threaded bore 12 until the head 34 of the tightening screw rests against the planar end face 35 of the spindle 2. As the tightening screw 11 is screwed in, the securing piston 13 is again moved back in the bore 9, thereby again resulting in the initially set securing pressure. It is no longer necessary to reduce the securing pressure via the filling valve 10 every time that an exchange of the tool is undertaken. Rather, this securing pressure is set only during filling with the pressure medium; all further securing processes are then effected merely by screwing the tightening screw 11 in or out in the manner described.

Provided in the spindle 2 is a screw plug 36 that can be reached from the end and that is open during the initial filling with pressure medium to thereby enable a venting during the filling. The screw plug 36 is subsequently screwed back into the closed position illustrated in FIG. 1.

The axial fixation of the tool 33 is effected by the two screws 30 and 31 in the holder 32, with these screws also serving to positively keep the tool 33 from twisting. The tool 33, along with the holder 32, are placed upon the securing sleeve 5 in such a way that the screws 30, 31 pass through the larger portions of the keyhole-like openings 28, 29 in the ring 19. The tool 33 is subsequently turned counter to the direction of rotation during operation, whereby the shafts of the screws 30, 31 pass into the narrower portions of the keyhole-like openings 28, 29. The heads of the screws then rest against the back side 37 of the ring 19. As soon as the shafts of the screws 30, 31 come to rest against the edge of the keyhole-like openings 28 and 29, further rotation of the tool carries the ring 19 along with it, thereby screwing the ring 19 further into the centrifugal ring 16 in a direction counter to the direction of rotation during operation. In so doing, the ring 19 axially draws the tool 32, 33 to such an extent until the holder 32 rests against the end face 38 of the centrifugal ring 16. In this way, the tool 32, 33 rests and is secured axially tightly against the centrifugal ring 16. The ring 19 holds the tool 32, 33 tightly in this position. The tightening screw 11 is subsequently tightened in the manner described, thus producing the securing pressure, so that the axially fixed tool 32, 33 is now also radially centered and secured.

The ring 19 is screwed into the recess 17 of the centrifugal ring 16 in such a way that during rotation of the ring 19 as the tool 32, 33 is being secured, there is in every case assured that the tool will also come to rest against the end face 38 of the centrifugal ring 16. During mounting of the securing apparatus, the stop means 24, 25, which are embodied as setscrews, are not screwed into the centrifugal ring 16 until the ring 19 assumes its installed position. In so doing, the ring 19 is screwed into the centrifugal ring 16 to such an extent that the elongated openings 26, 27 of the ring 19 are disposed in the region of the threaded bores that are provided for receiving the stop means 24, 25. The openings 26, 27 are of such a length, and the stop means 24, 25 are disposed within the openings in such a way, that when the tool 32, 33 is installed, the ring 19 can in each case be turned to such an extent that the tool comes to rest against the end face 38 of the centrifugal ring 16.

The screws 30, 31 can be set precisely axially in the holder 32 in such a way that the distance of the screw head from the adjacent side face 39 of the holder 32 corresponds to the thickness of the ring 19 plus a slight overmeasure for introduction purposes. After rotation of the ring 19 on the thread 18, the tool 32, 33 cannot be axially shifted relative to the ring 19 in the installed position.

To effect removal, after loosening of the tightening screw 11 the tool 32, 33 and the ring 19 are backed off or rotated back to such an extent that the stop means 24, 25 come to rest against the appropriate edge of the elongated openings 26, 27 in the ring 19. The tool can then be removed, with the heads of the screws 30, 31 being adapted to be withdrawn through the larger portions of the keyhole-like openings 28, 29 in the ring 19.

The ring 19 axially positions the tool 32, 33 in the manner described. Since during rotation the ring 19 is screwed into the centrifugal ring 16, the tool 32, 33 is shifted in the axial direction, so that when the tool rests against the end face 38 of the centrifugal ring 16, an engagement force that acts in the axial direction is also produced.

During a possible loss in pressure, the ring 19 prevents the tool 32, 33 from being slid from the spindle 2. Since the tool 32, 33 is turned counter to the direction of rotation during operation, if a drop in hydraulic pressure occurred the ring 19 would be screwed still further into the centrifugal ring 16 counter to the direction of rotation during operation. In this way, the tool 32, 33 cannot be unintentionally slid from the spindle 2.

The present invention is, of course, in no way restricted to the specific disclosure of the specification and drawings, but also encompasses any modifications within the scope of the appended claims.

What I claim is:

1. A securing apparatus for a tool, especially for a grinding wheel, comprising:

a rotatably driven spindle;

a hydraulically expandable securing member for securing said tool on said spindle, with said securing member being a securing sleeve that is fixedly disposed on said spindle, and with said securing sleeve having at least one hydraulic medium chamber, which communicates with a first bore that extends through said spindle and is provided for supplying hydraulic medium;

a tightening screw that closes off said spindle, with said tightening screw being movable between a pressure establishing position and a pressure relief position; and at least one axial securing element that is axially displaceably disposed on said securing apparatus and is adapted to be positively connected with said tool in an axial direction and in a direction counter to the direction of rotation of said tool during operation, with said at least one axial securing element producing an axially acting engagement force against said tool that causes said tool to rest against an abutment face provided for said spindle wherein said tool is provided with interlock elements and said axial securing element is a first ring that is provided with interlock openings for receiving said interlock elements of said tool.

2. An apparatus according to claim 1, in which said spindle has an end that is provided with a threaded bore into which said tightening screw is screwed.

3. An apparatus according to claim 1, which includes a securing piston that is disposed in said first bore of said spindle and that, under the pressure of said hydraulic medium, rests against said tightening screw.

4. An apparatus according to claim 3, in which said securing piston is guided in said first bore in a sealed manner.

5. An apparatus according to claim 1, in which said interlock openings have a keyhole-shaped configuration.

6. An apparatus according to claim 5, in which said interlock elements are screws that project in an axial direction from said tool and extend through said interlock openings of said axial securing element.

7. An apparatus according to claim 6, in which said interlock openings are disposed diametrically across from one another.

8. An apparatus according to claim 1, which includes a receiving member into which said axial securing element is adapted to be screwed.

9. An apparatus according to claim 8, in which said receiving member is a centrifugal ring that is disposed on said spindle and has an end face provided with a recess for receiving said axial securing element.

10. An apparatus according to claim 9, in which said axial securing element is rotatable to a limited extent relative to said centrifugal ring.

11. An apparatus according to claim 10, in which said axial securing element is provided with openings, and in which said centrifugal ring is provided with stop means that extend into said openings.

12. An apparatus according to claim 11, in which said openings of said axial securing element are disposed diametrically across from one another.

13. An apparatus according to claim 11, in which said openings of said axial securing element are elongated holes that are curved in the shape of part of a circle.

14. An apparatus according to claim 11, in which said stop means of said centrifugal ring are screws that extend axially relative to said spindle.

15. An apparatus according to claim 9, in which said abutment face provided for said spindle is said end face of said centrifugal ring.

* * * * *